US010800571B2

(12) United States Patent
Chou

(10) Patent No.: US 10,800,571 B2
(45) Date of Patent: Oct. 13, 2020

(54) QUICK LIFT ASSEMBLING STORAGE BOX

(71) Applicant: Chi-Ming Chou, Taipei (TW)

(72) Inventor: Chi-Ming Chou, Taipei (TW)

( * ) Notice: Subject to any disclaimer, the term of this patent is extended or adjusted under 35 U.S.C. 154(b) by 0 days.

(21) Appl. No.: 16/357,365

(22) Filed: Mar. 19, 2019

(65) Prior Publication Data

US 2020/0239182 A1 Jul. 30, 2020

(30) Foreign Application Priority Data

Jan. 30, 2019 (TW) ..... 108103518 A

(51) Int. Cl.
*B65D 5/36* (2006.01)
*B65D 5/44* (2006.01)
*B65D 5/42* (2006.01)

(52) U.S. Cl.
CPC ..... *B65D 5/3635* (2013.01); *B65D 5/3664* (2013.01); *B65D 5/4266* (2013.01); *B65D 5/443* (2013.01)

(58) Field of Classification Search
CPC ..... B65D 5/365; B65D 5/3635–3664
USPC ..... 229/117.01, 117.03, 117.07–117.08, 229/122.34
See application file for complete search history.

(56) References Cited

U.S. PATENT DOCUMENTS 959,261 A * 5/1910 Reber ..... B65D 5/566 229/122.34
1,200,840 A * 10/1916 Houghland ..... B65D 5/3664 229/181
1,364,899 A * 1/1921 Smith ..... B65D 5/62 229/182
4,762,270 A * 8/1988 Stoll ..... B65D 5/324 229/117.01
5,055,084 A * 10/1991 Jokic ..... A63H 13/16 40/539
5,421,509 A * 6/1995 Thuin ..... B65D 5/3642 229/117.03
5,855,317 A * 1/1999 Dalrymple ..... B65D 5/241 229/117.07

* cited by examiner

*Primary Examiner* — Nathan J Newhouse
*Assistant Examiner* — Phillip D Schmidt

(57) ABSTRACT

A quick lift assembling storage box includes a folding box in a flat half-folded state, and a traction support board disposed at the top of the folding box. After a user lifts the traction support board to drive and change the folding box in the flat half-folded state into a three-dimensional state with an accommodation space, and then the user can press and superimpose the traction support board onto the bottom and the inner sides of the folding box to reinforce the strength of the folding box.

8 Claims, 11 Drawing Sheets

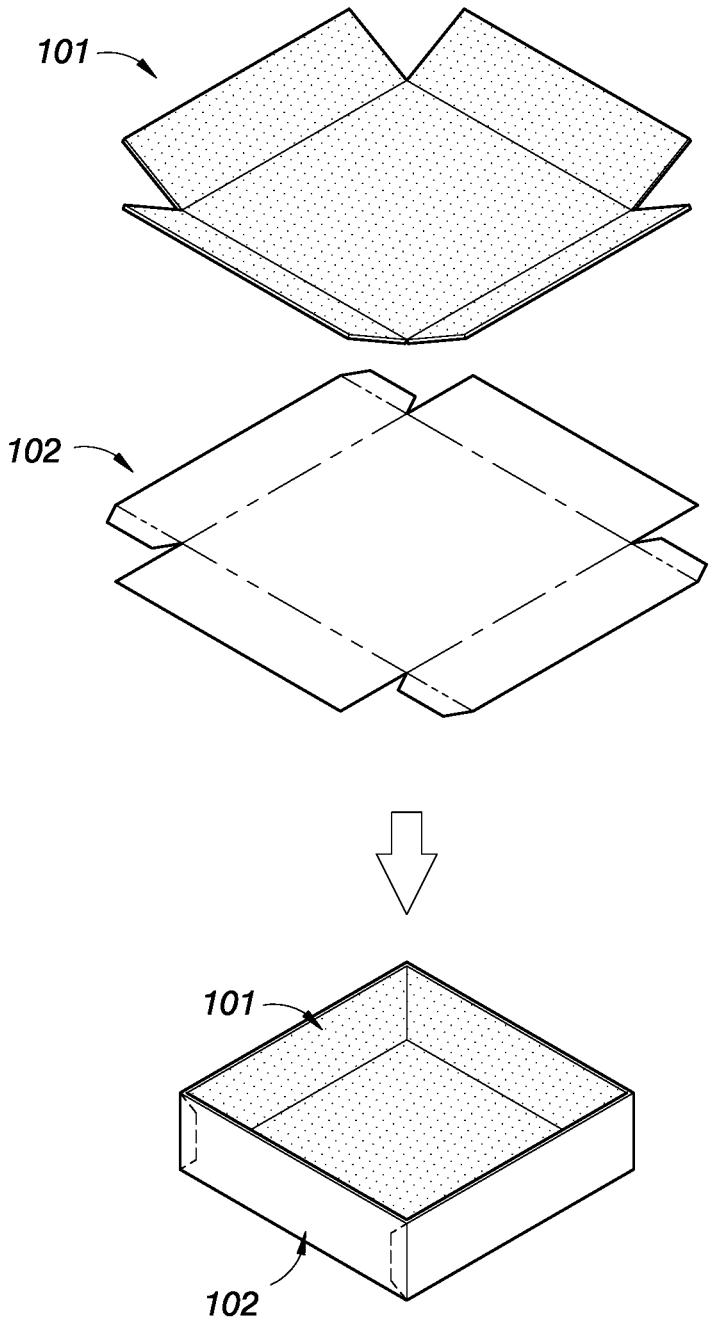
PRIORART
FIG.1

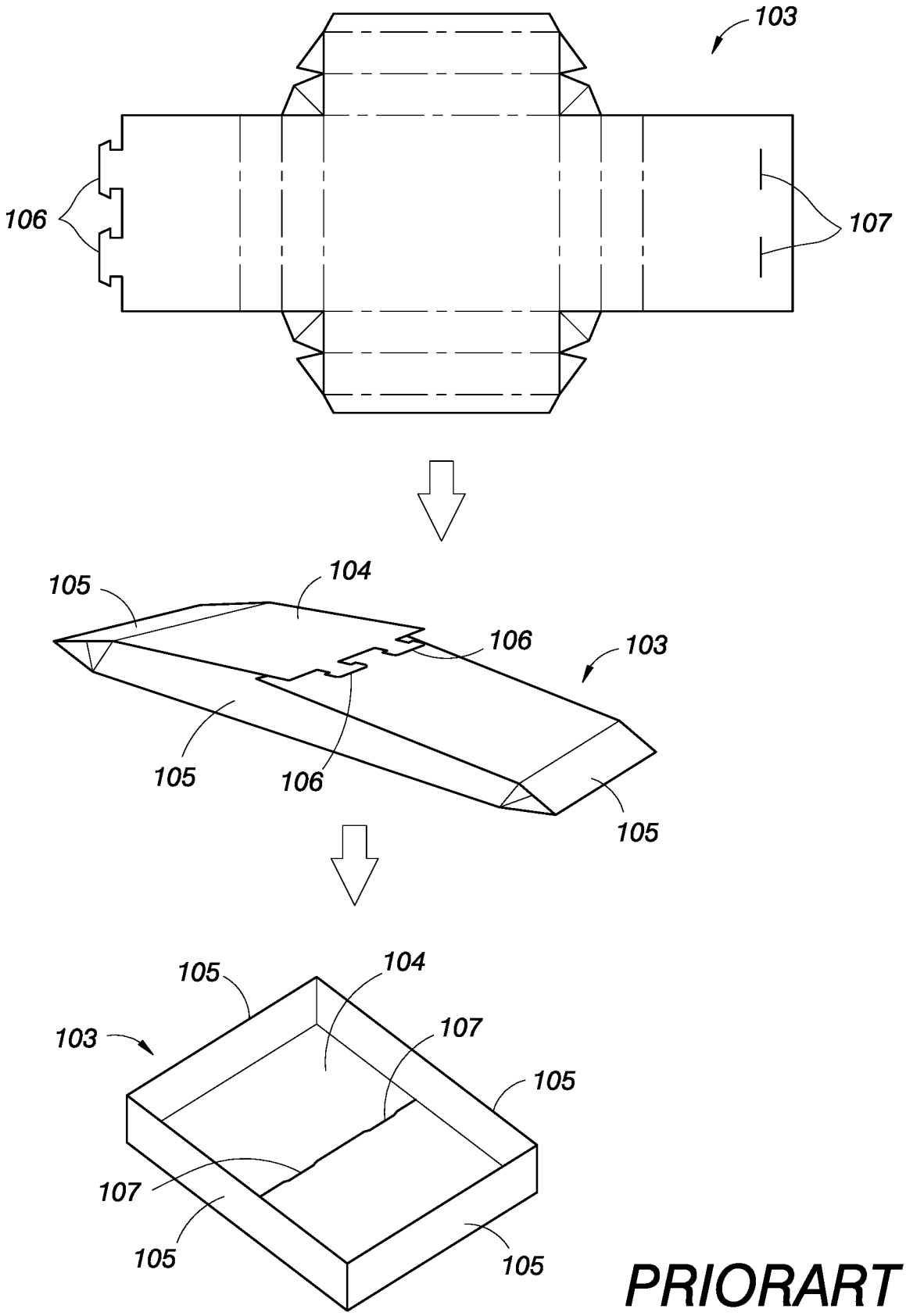
PRIORART
FIG.2

QUICK LIFT ASSEMBLING STORAGE BOX

FIELD OF THE INVENTION

The present invention relates to the field of a storage box made of paper, and more particularly to a storage box that can be assembled quickly by a lifting method or disassembled into a flat state, and the invention is capable of reinforcing the strength of the storage box.

BACKGROUND OF THE INVENTION

With reference to FIG. 1 for a conventional storage box made of paper for the purpose of printing beautiful patterns, the paper storage box has the drawback of insufficient strength, and thus may be deformed easily when heavy objects are stored in the paper storage box. To reinforce the strength of the paper storage box, some manufacturers uses an inner paper box 101 with a greater thickness as an inner layer or a pad for an exquisite outer box 102. During an assembling process, the inner box 101 must be adhered onto the top of the outer box 102 before the surrounding side boards are erected (or the storage board is still in form of a cardboard), and then the plurality of side boards of the outer box 102 are erected from the surrounding of the bottom board to form a storage box in a three-dimensional state and having an accommodation space. However, after such exquisite storage box is reinforced and fixed, the storage box cannot be unfolded to return to its flat state. Therefore, these conventional storage boxes have the disadvantages of requiring a larger storage space and incurring a higher transportation cost.

With reference to FIG. 2 for a storage box as disclosed in Japan Patent Publication No. 200043846, the storage box is formed by cutting and folding a cardboard integrally, and the storage box 103 so formed has a double-layer bottom board 104 and a double-layer side board 105. Although this storage box can omit the adhesion and fixation steps and shorten the assembling time, yet the inner layer and the outer layer are made of the same cardboard or the same material. To facilitate the folding process, the storage box still has to be made of thinner cardboard. Even with the double-layer structure, there still has the doubt of insufficient strength. If a thicker cardboard is used to form the storage box, then the storage box will not be able to be folded and assembled easily. Furthermore, the folded and assembled storage box with an engagement portion 106 disposed at the center of the double-layer bottom board 104 may have the issue of unsightly protruding from the position of a seam 107, and make the storage box not looking exquisite or beautiful. Furthermore, the assembled storage box cannot be disassembled easily.

It is a common practice to assemble the folding storage box into a flat half-folded state to facilitate storage and transportation. After the flat half-folded storage box is transported to a sales end, the sellers will assemble the flat half-folded storage box to form a storage box in a three-dimensional state. However, when the storage box as disclosed in Japan Patent Publication No. 200043846 is assembled, the sellers have to connect the engagement portions 106 on both sides before the storage box can be assembled. Such assembling process is cumbersome, and thus not only increasing the consumer's waiting time for packaging, but also affecting the service and management of the related industry.

In view of the aforementioned drawbacks of the conventional storage box such as the incapability of being folded easily for storage, the inconvenient assembling procedure, and the insufficient structural strength, the inventor of the present invention based on years of experience in the related industry to conduct extensive research and experiment, and finally developed a quick lift assembling storage box to overcome drawbacks of the prior art.

SUMMARY OF THE INVENTION

Therefore, it is a primary objective of the present invention to overcome the aforementioned drawbacks of the prior art by providing a quick lift assembling storage box that allows users to lift and operate a traction support board to drive and change the folding box in a flat half-folded state into a folding box in a three-dimensional state, and the invention also allows the assembled storage box to be disassembled into the original flat state quickly when not in use. In addition, the traction support board is also provided for reinforcing the strength of the folding box.

To achieve the aforementioned and other objectives, the present invention provides a quick lift assembling storage box, comprising: a folding box situated in a flat half-folded state and having a traction support board with a thickness greater than that of the folding box and movably installed to the top of the folding box, and the folding box further comprising a bottom board, and front and rear side boards and left and right side boards extending outwardly from four sides of the bottom board respectively, and the left and right side boards being inwardly folded to both sides of the bottom board, and a linkage plate being disposed at the four corners where the front and rear side boards and the left and right side boards are intersected, and the linkage plates being coupled to one another, characterized in that the outer edges of the front and rear side boards of the folding box are reversely folded, extended and fixed to front and rear reverse folding plates disposed at the front and rear sides of the traction support board respectively; the traction support board has front and rear fold lines for relatively bending and dividing the traction support board into two movable support plates disposed on both front and rear sides, and a bottom support plate is disposed between the two movable support plates, and the center of the bottom support plate has a central fold line parallel to the front and rear fold lines, and the center of the bottom support plate further has a lifting portion provided for a user to apply a force; the lifting portion is lifted, so that the two movable support plates drive the front and rear side boards of the folding box to stand up with respect to the bottom board, and after the left and right side boards are dragged by the plurality of linkage plates to stand up, and then the bottom support plate of the traction support board is pressed down, so that the bottom support plate is flatly superimposed onto the top of the bottom board, and the two movable support plates are reversely folded and superimposed onto the inner sides of the front and rear side boards to assemble the folding box and the traction support board quickly to define a three-dimensional state with an accommodation space.

Compared with the prior art, users may lift and operate the traction support board to drive the flat folding box to be assembled into a three-dimensional state quickly, and pull the traction support board in a reverse direction when the storage box is not in use to let the folding box return to its flat state. In addition, the traction support board and the folding box may be made of cardboards of different thicknesses, and such arrangement not just can lower the material cost only, but the traction support board also can reinforce the structural strength of the folding box. The invention overcomes the drawbacks of the conventional storage box such as the incapability of being folded easily for storage, the inconvenient assembling procedure.

The technical contents of the present invention will become apparent with the detailed description of preferred embodiments accompanied with the illustration of related drawings as follows.

BRIEF DESCRIPTION OF THE DRAWINGS

FIG. 1 is a schematic view showing the structure of a conventional exquisite storage box;

FIG. 2 is a schematic view showing the structure of a conventional folding storage box;

DESCRIPTION OF THE PREFERRED EMBODIMENTS

Figure 3:
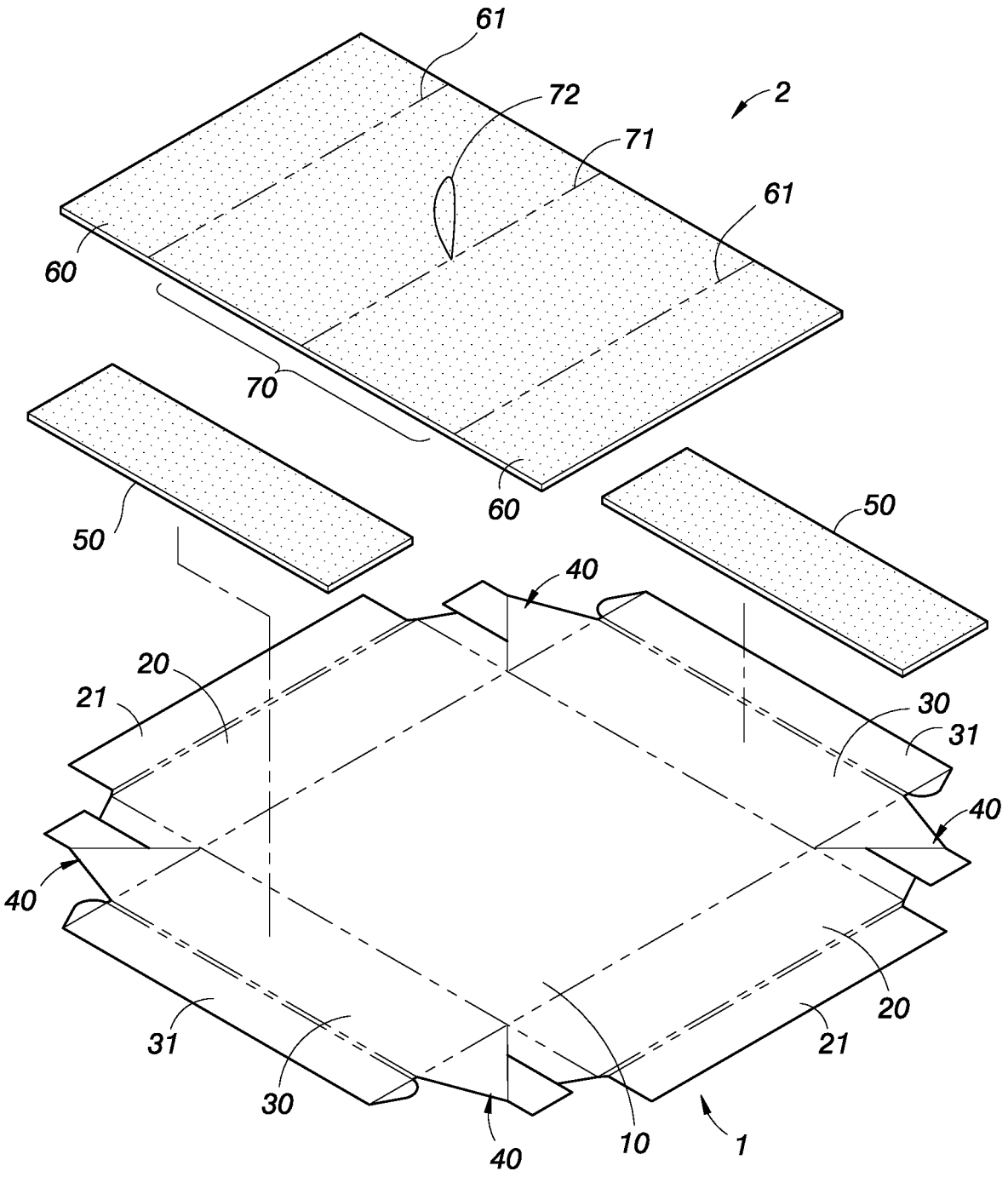
FIG. 3 is an exploded view of the present invention.
Figure 4:
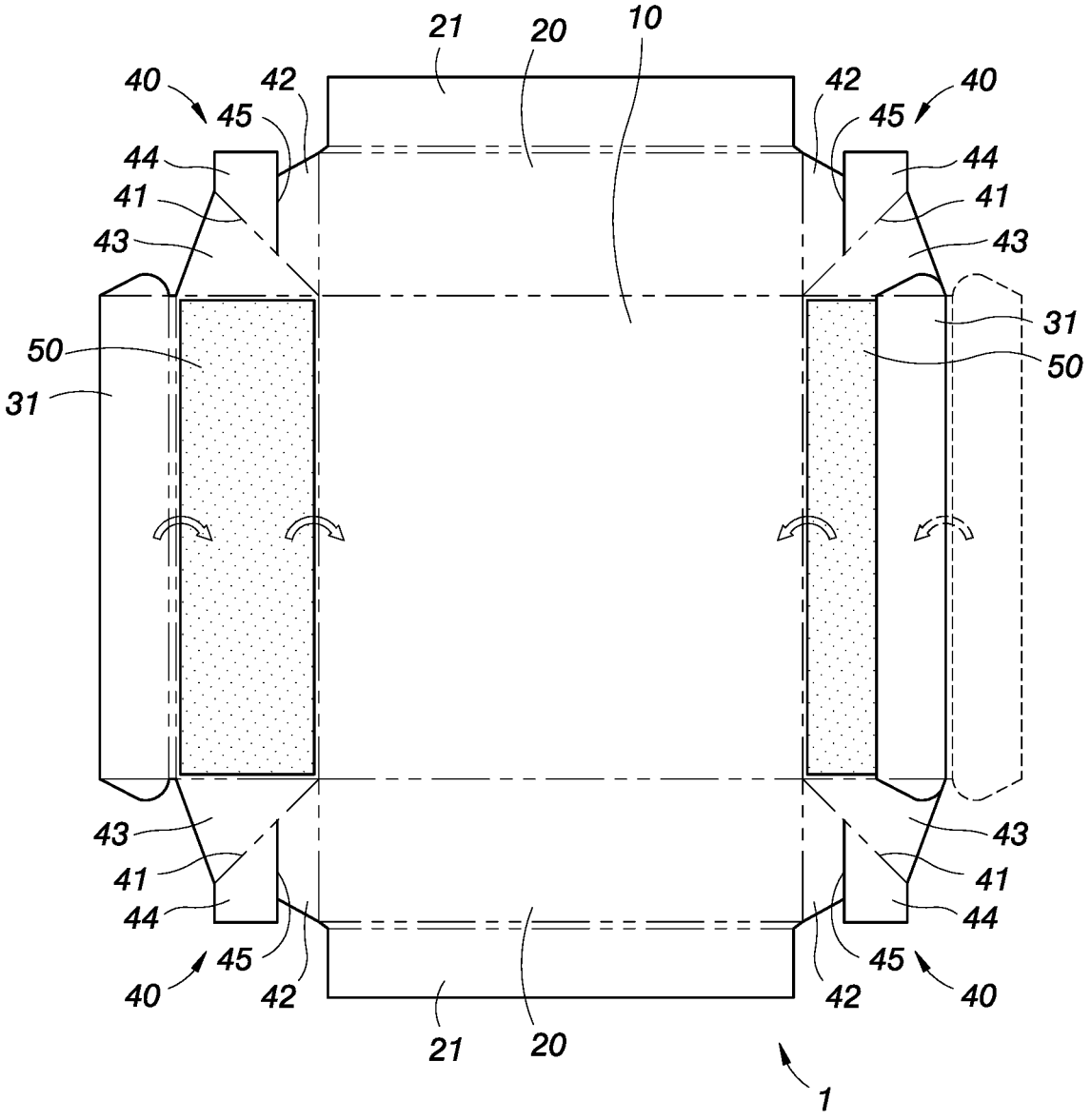
FIG. 4 is a schematic view of assembling a folding box and a fixed support plate in accordance with the present invention.

With reference to FIGS. 3 and 4 for a quick lift assembling storage box of the present invention, the quick lift assembling storage box comprises a folding box 1 that can be folded into a flat half-folded state, and a traction support board 2 that can drive the folding box 1 from a half-folded state into a three-dimensional state.

The folding box 1 is formed by cutting and folding a thinner cardboard integrally, and the folding box 1 comprises a bottom board 10, front and rear side boards 20 extending outwardly from the front and rear sides of the bottom board 10 respectively, left and right side boards 30 extending from the left and right sides of the bottom board 10 respectively, and a linkage plate 40 disposed at four corners formed by the intersections of the front and rear side boards 20 and the left and right side boards 30 separately and the linkage plates 40 are coupled to one another.

Left and right reverse folding plates 31 extend from the outer edges of the left and right side boards 30 respectively, and the left and right reverse folding plates 31 are reversely folded and adhered onto the corresponding left and right side boards 30, or as shown in the figure, a fixed support plate 50 with a thickness greater than the cardboard of the folding box 1 is disposed at the inner sides of the left and right side boards 30 separately, and the left and right reverse folding plates 31 are reversely folded and adhered to the corresponding inner side of the fixed support plate 50.

Figure 5:
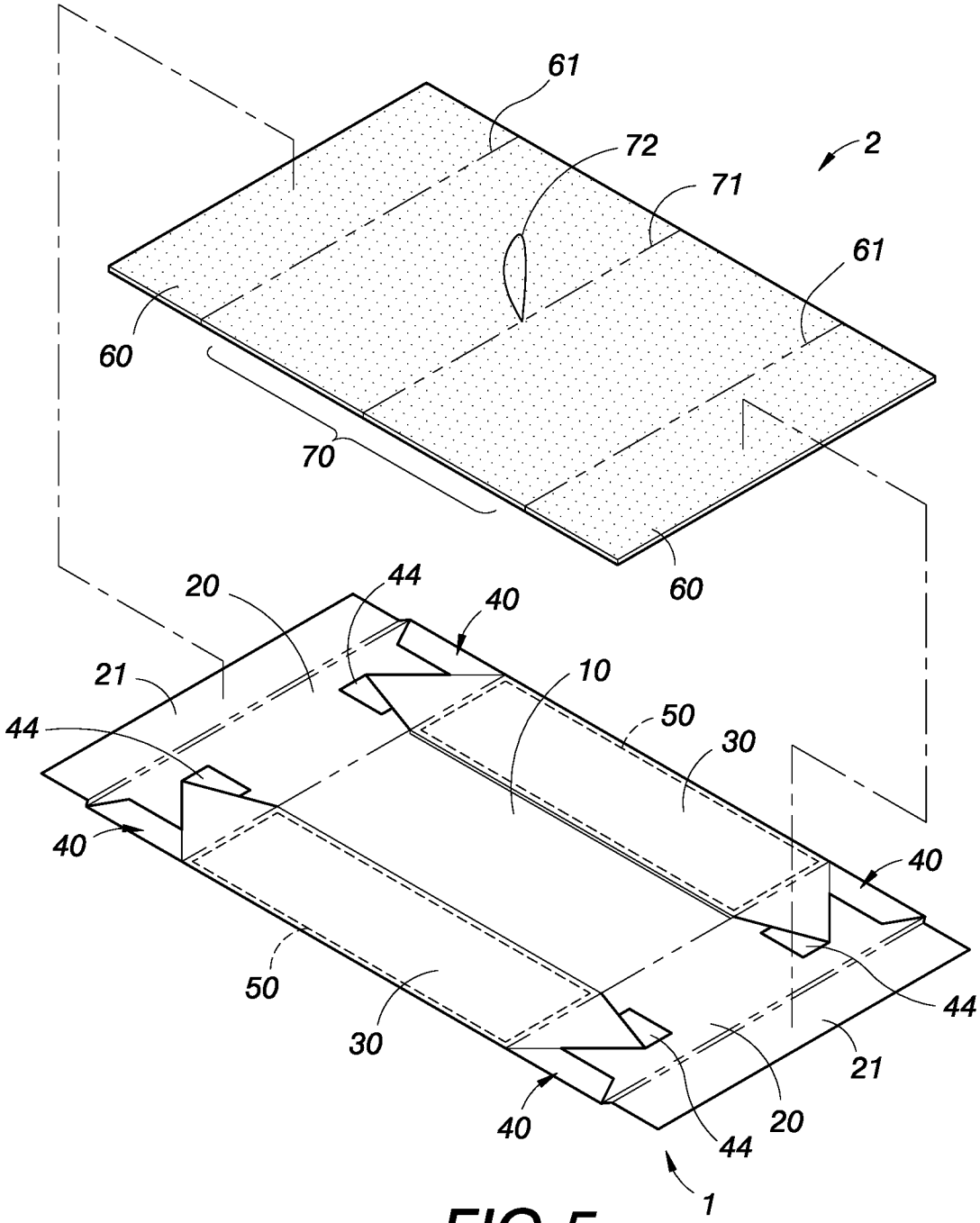
FIG. 5 is an exploded view of a folding box in a flat half-folded state and a traction support board in accordance with the present invention.
Figure 6:
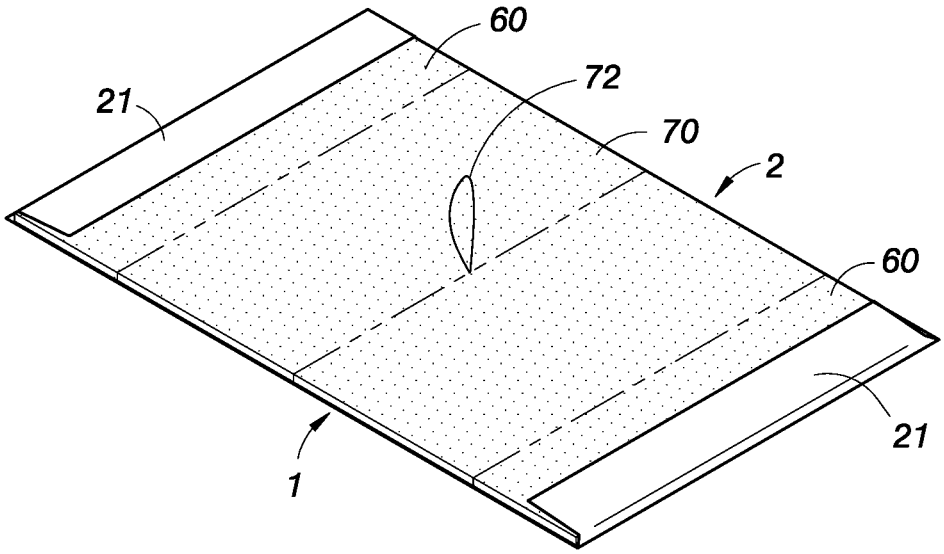
FIG. 6 is a schematic view of a folding box in a flat half-folded state combined with a traction support board in accordance with the present invention.

In FIGS. 5 and 6, the left and right side boards 30 of the folding box 1 and the corresponding fixed support plate 50 are folded towards the center of the bottom board 10 and superimposed on the top of the bottom board 10, and each linkage plate 40 is folded towards the center of the front and rear side boards 20 and fixed to the top of front and rear side boards 20 to define a flat half-folded state.

The traction support board 2 has a thickness greater than the cardboard of the folding box 1 and has two movable support plates 60 corresponding to the front and rear side boards 20 of the folding box 1, and a bottom support plate 70 corresponding to the bottom board 10 of the folding box 1, and the two movable support plates 60 and the bottom support plate 70 are divided and formed by both front and rear fold lines 61, and a central fold line 71 is formed at the center of the bottom support plate 70 and parallel to the front and rear fold lines 61, and a lifting portion 72 is disposed at the center of the bottom support plate 70 and provided for a user to apply a force.

The traction support board 2 is superimposed on the left and right side boards 30 of the folding box 1 in the half-folded state and the top of the plurality of linkage plates 40, and front and rear reverse folding plates 21 extend from the outer edges of the front and rear side boards 20 of the folding box 1 respectively and the front and rear reverse folding plates 21 may be reversely folded and fixed onto the two movable support plates 60 of the traction support board 2.

Figure 7:
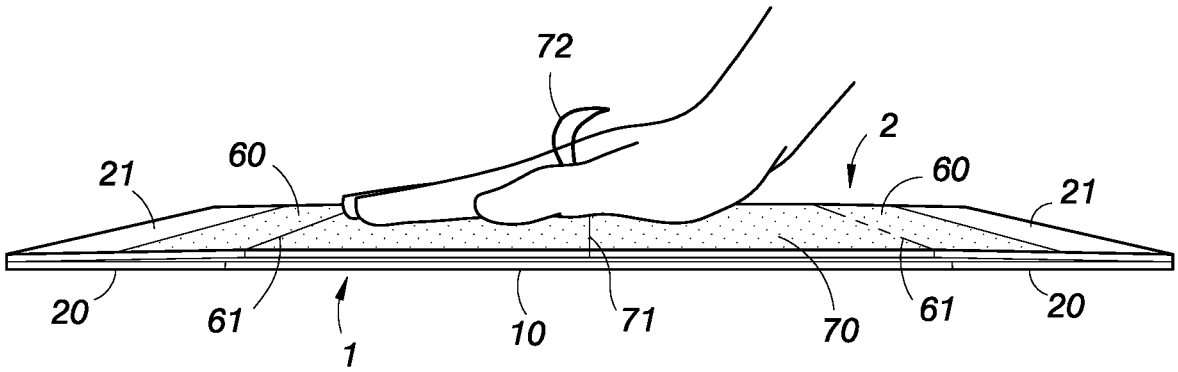
FIG. 7 is a first schematic view of an assembly of the present invention.
Figure 8:
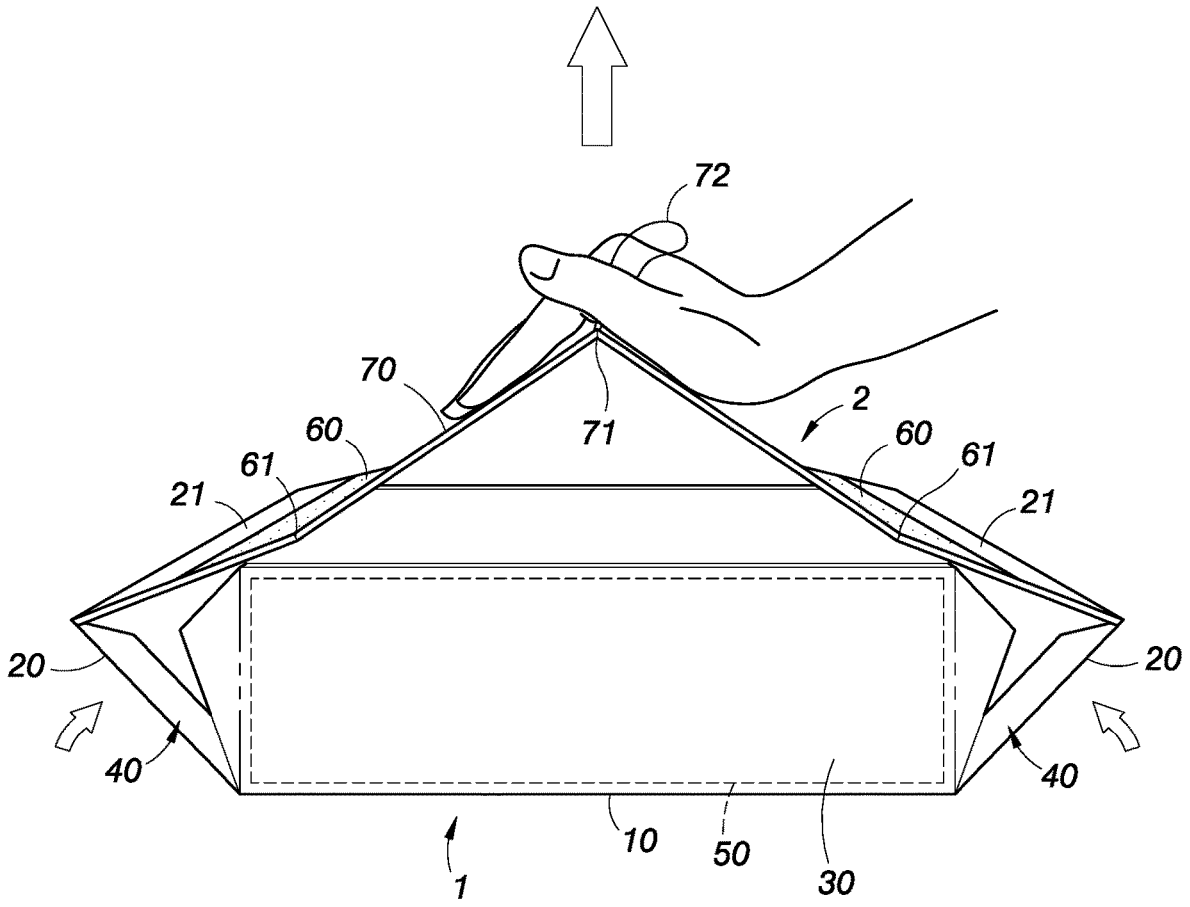
FIG. 8 is a second schematic view of an assembly of the present invention.

In FIGS. 7 and 8, a user can lift the lifting portion 72 of the traction support board 2, and grip the bottom support plate 70 to apply a force, so that the bottom support plate 70 is bent and uplifted along the central fold line 71, and the two movable support plates 60 are bent upwardly along both front and rear fold lines 61 with respect to the bottom support plate 70, while driving the front and rear side boards 20 to stand up with respect to the bottom board 10, and the plurality of linkage plates 40 drag the left and right side boards 30 to be erected from the corresponding fixed support plate 50.

Figure 9:
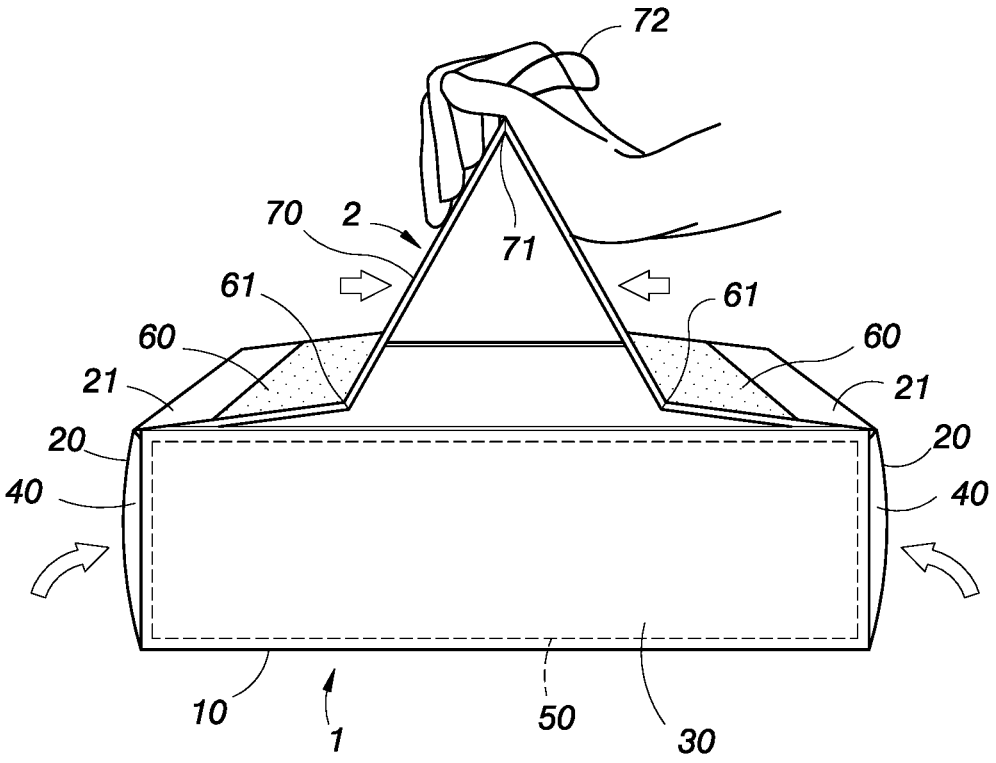
FIG. 9 is a third schematic view of an assembly of the present invention.
Figure 10:
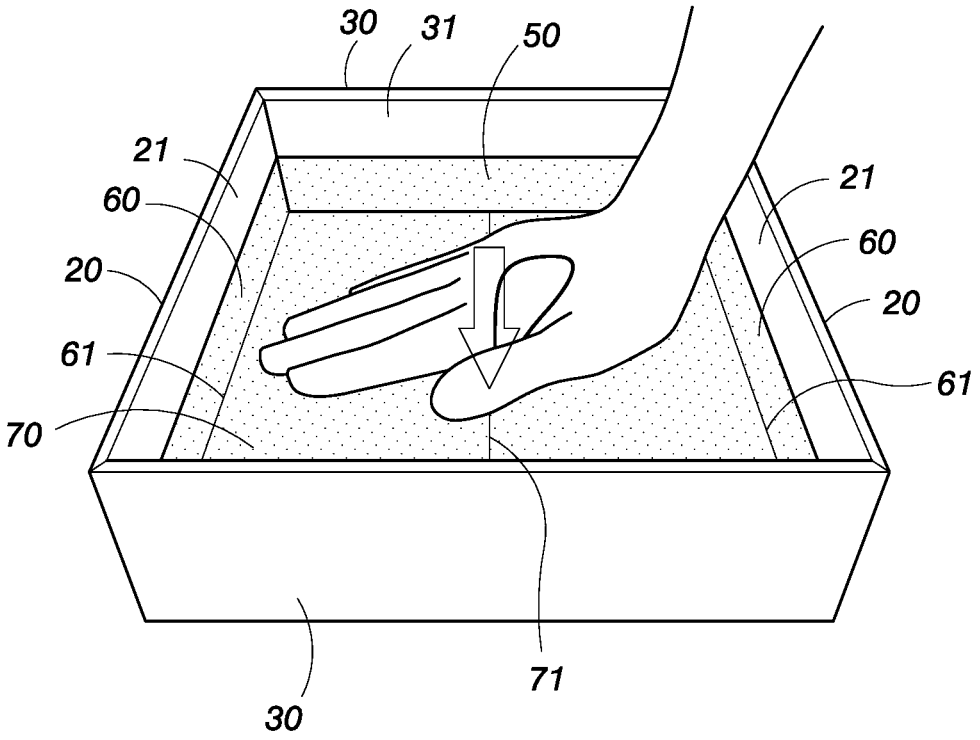
FIG. 10 is a fourth schematic view of an assembly of the present invention.

In FIGS. 9 and 10, after the front and rear side boards 20 and the left and right side boards 30 stand up, the linkage plate 40 is superimposed on the inner sides of the front and rear side boards 20, and the user may press the bottom support plate 70 of the traction support board 2 to flatly superimpose the bottom support plate 70 onto the top of the bottom board 10, and the two movable support plates 60 are folded reversely and superimposed onto the front and rear side boards 20 and the corresponding inner sides of the plurality of linkage plates 40, so as to assemble the folding box 1 and the traction support board 2 quickly to form a storage box in a three-dimensional state and having an accommodation space.

When the storage box is not in use, the traction support board 2 may be lifted from the top of the bottom board 10 of the folding box 1 in a sequence as shown in FIGS. 10 to 7 and the traction support board 2 is removed in a reverse direction to let the folding box 1 return to its flat half-folded state. In addition, the traction support board and the folding box are made of cardboards of different thicknesses, and such arrangement not just reduces the material cost only, but the traction support board also can reinforce the structural strength of the folding box to overcome the drawbacks of the conventional storage box such as the incapability of being folded easily for storage, the inconvenient assembling procedure, and the insufficient structural strength.

When the users are familiar with the assembling procedure of the storage box, the users can lift the traction support board by one hand as shown in the figure, so as to assemble the storage box more quickly. In practice, the lifting portion 72 may be a drawstring (as shown in the figure), or a buckle (not shown in the figure), or a through hole (not shown in the figure) dug from the bottom support plate, or any other component provided for the users to apply a force.

Figure 11:
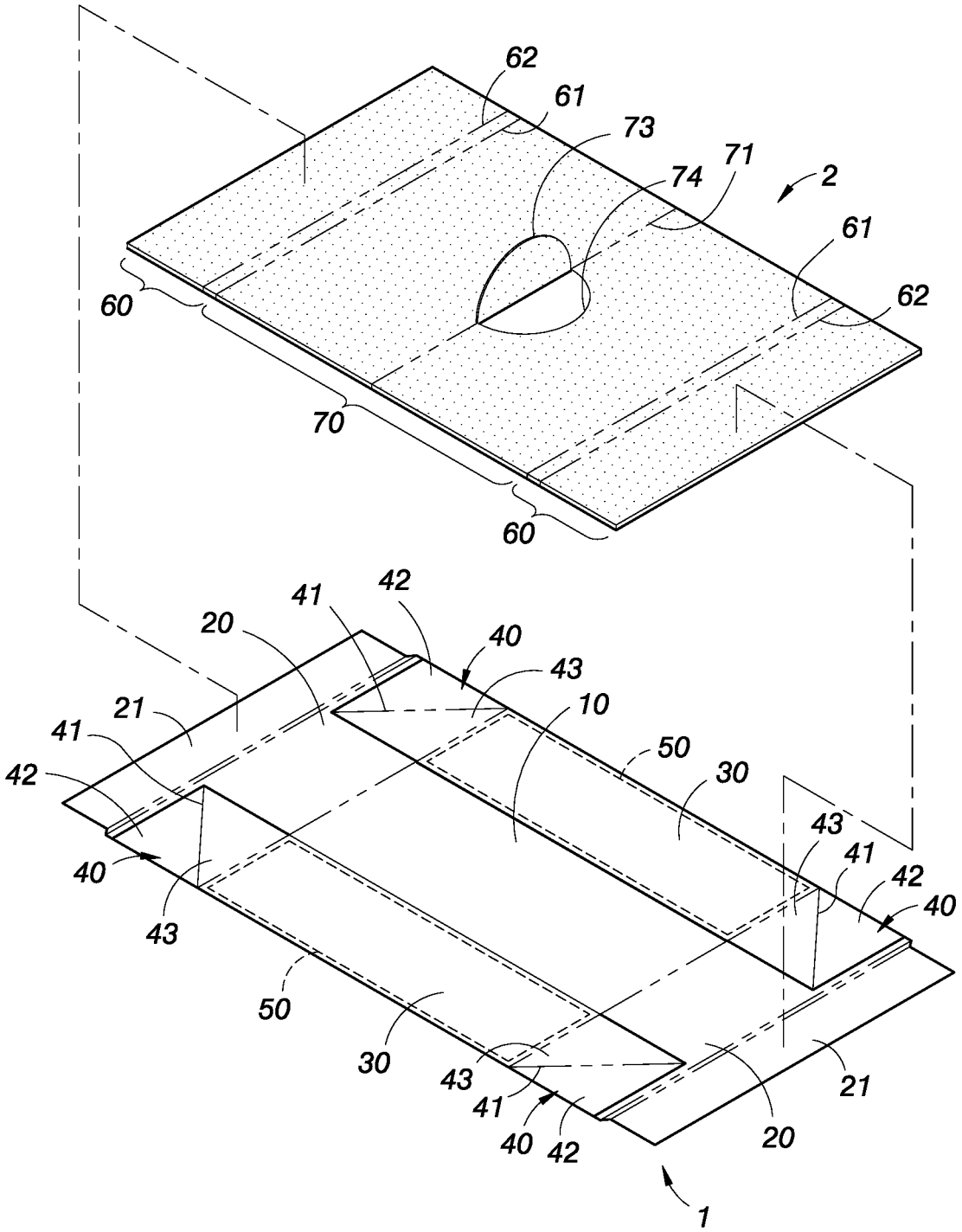
FIG. 11 is a schematic view of a traction support board and a linkage plate in accordance with another embodiment of the present invention.

In FIG. 11, the lifting portion is a lift-up force applying plate 73 formed by a semicircular cut line 74 disposed at the center of the central fold line 71 of the bottom support plate 70, so that the lift-up force applying plate 73 can be erected along the semicircular cut line 74 to stand up with respect to the bottom support plate 70 and provided for the users to lift. On the other hand, when the front and rear side boards 20 and the left and right side boards 30 are erected, and the bottom support plate 70 is flatly superimposed onto the top of the bottom board 10, the lift-up force applying plate 73 can also be flatly superimposed onto the top of the bottom board 10, so as to maintain a flat inner bottom surface of the whole storage box.

In addition, the traction support board 2 has a second fold line 62 defined separately on the two movable support plates 60 and disposed near and parallel to the front and rear fold lines 61. When the folding box 1 comes with a relatively larger size, the two second fold lines 62 can assist the two movable support plates 60 to be folded reversely and superimposed onto the front and rear side boards 20 and the inner sides of the plurality of linkage plates 40, so as to facilitate the users to assemble the storage box.

In FIGS. 3 and 4, each linkage plate 40 has an oblique crease 41 extending in a diagonal direction, so that the linkage plate 40 is divided into a first folding plate 42 coupled to the front and rear side boards 20 and a second folding plate 43 coupled to the left and right side boards 30, and the outer side edge of the first folding plate 42 has a positioning plate 44 facing the front and rear side boards 20, and a cutting line 45 is defined at the intersection position of the positioning plate 44 and the first folding plate 42, wherein the cutting line 45 extends from the outside to the inside until it reaches the oblique crease 41, so that the positioning plate 44 is folded towards the front and rear side boards 20 by using the oblique crease 41 as the baseline.

When the folding box 1 is in the flat half-folded state, the inner sides of the first and second folding plates 42, 43 of each linkage plate 40 are superimposed onto the adjacent front and rear side boards 20 respectively, and the positioning plate 44 is folded along the oblique crease 41 and then the outer side of the positioning plate 44 is adhered and fixed onto the front and rear side boards 20.

When the front and rear side boards 20 are erected with respect to the bottom board 10, the first and second folding plates 42, 43 of each linkage plate 40 are folded along the oblique crease 41 and then superimposed onto the corresponding inner sides of the front and rear side boards 20, so as to drive the left and right side boards 30 to be erected with respect to the bottom board 10. During the process of the linkage plate 40 driving the left and right side boards 30 to be erected, the positioning plate 44 folded reversely and fixed to the front side board or the rear side board can change the direction of the action force exerted onto the first folding plate 42 linked with the second folding plate 43 and reduce the resistance between the first and second folding plates 42, 43. Therefore, the linkage plate 40 can smoothly drag the left and right side boards 30 to be erected.

In FIG. 11, the linkage plate 40 may also adopt a common folding method. Similarly, a user can lift the traction support board 2 to drive the flat folding box to be assembled quickly into a three-dimensional state.

While the present invention has been described by means of specific embodiments, numerous modifications and variations could be made thereto by those skilled in the art without departing from the scope and spirit of the present invention set forth in the claims.

What is claimed is:

1. A quick lift assembling storage box, comprising:

a folding box in a flat half-folded state, and a traction support board with a thickness greater than that of the folding box, the traction support board movably installed to a top of the folding box;

the folding box in the flat half-folded state further comprising:

a bottom board, front and rear side boards, and left and right side boards respectively extending outwardly from four sides of the bottom board respectively, the left and right side boards being inwardly folded against the bottom board, and a respective linkage plate disposed at four corners where the front and rear side boards and the left and right side boards intersect;

wherein outer edges of the front and rear side boards respectively comprise a reverse folding plate, the reverse folding plates folded onto and fixedly connected to front and rear sides of the traction support board respectively;

the traction support board has front and rear fold lines defining two movable support plates respectively disposed on the front and rear sides, and a bottom support plate disposed between the two movable support plates;

a center of the bottom support plate has a central fold line parallel to the front and rear fold lines, and the center of the bottom support plate further has a lifting portion configured to allow a user to apply a force to the support plate;

wherein when the lifting portion is lifted via the lifting portion, the two movable support plates drive the front and rear side boards of the folding box to stand up with respect to the bottom board, and the left and right side boards are dragged by the plurality of linkage plates to stand up, and then the bottom support plate of the traction support board is pressable downward so that the bottom support plate is disposed against a top of the bottom board, and the two movable support plates are folded against inner sides of the front and rear side boards to assemble the storage box and define a three-dimensional state with an accommodation space.

2. The quick lift assembling storage box according to claim 1, wherein the lifting portion is a lift-up force applying plate formed by a semicircular cut line which is disposed at a center of the central fold line of the bottom support plate, such that the lift-up force applying plate can be lifted along the semicircular cut line to stand up with respect to the bottom support plate and provided for the user to lift.

3. The quick lift assembling storage box according to claim 1, wherein the lifting portion is a drawstring, a buckle, or a through hole disposed on the bottom support plate.

4. The quick lift assembling storage box according to claim 1, further comprising left and right reverse folding plates extending from outer edges of the left and right side boards and folded onto and adhered to the corresponding inner sides of the left and right side boards respectively.

5. The quick lift assembling storage box according to claim 1, wherein when the lifting portion is lifted, the bottom support plate is bent and uplifted along the central fold line, and the two movable support plates are bent along both front and rear fold lines to drive the front and rear side boards of the folding box to stand up with respect to the bottom board.

6. The quick lift assembling storage box according to claim 1, wherein the traction support board has a second fold line defined on each of the two movable support plates and disposed adjacent to and parallel to the front and rear fold lines.

7. The quick lift assembling storage box according to claim 1, wherein each linkage plate has a first folding plate coupled to the adjacent front and or rear side boards, and a second folding plate coupled to the adjacent left or right side boards, an oblique crease formed between the first and second folding plates, and the first folding plate is folded along the oblique crease and fixedly connected to the adjacent front or rear side boards.

8. The quick lift assembling storage box according to claim 7, wherein each first folding plate has a positioning plate extending along the front and rear side boards, and a cutting line is formed at an intersection position of the positioning plate and the first folding plate, the cutting line extending to the oblique crease, the positioning plate using the oblique crease as a baseline to fold onto and be fixed onto the front side board or the rear side board.

* * * * *